US007678024B2

(12) United States Patent
Alexander

(10) Patent No.: US 7,678,024 B2
(45) Date of Patent: Mar. 16, 2010

(54) TRAMPOLINE

(75) Inventor: Keith Vivian Alexander, Christchurch (NZ)

(73) Assignee: Board & Batten International Inc., Georgetown (KY)

( * ) Notice: Subject to any disclaimer, the term of this patent is extended or adjusted under 35 U.S.C. 154(b) by 0 days.

(21) Appl. No.: 12/147,094

(22) Filed: Jun. 26, 2008

(65) Prior Publication Data

US 2009/0005221 A1 Jan. 1, 2009

(51) Int. Cl.
*A63B 21/02* (2006.01)

(52) U.S. Cl. ..... 482/27; 482/28

(58) Field of Classification Search ..... 482/27, 482/28; 5/666

See application file for complete search history.

(56) References Cited

U.S. PATENT DOCUMENTS 6,319,174 B1 * 11/2001 Alexander ..... 482/27
2004/0171461 A1 * 9/2004 Alexander ..... 482/27
2004/0171462 A1 * 9/2004 Alexander ..... 482/27
2005/0113213 A1 * 5/2005 Alexander ..... 482/27
2007/0004559 A1 * 1/2007 Alexander ..... 482/27

FOREIGN PATENT DOCUMENTS

WO 03/043704 5/2003
WO 2004/105886 12/2004

* cited by examiner

*Primary Examiner*—Jerome Donnelly
(74) *Attorney, Agent, or Firm*—Dann, Dorfman, Herrell and Skillman, P.C.

(57) ABSTRACT

The invention comprises a trampoline including a flexible mat, a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the upper end of a flexible rod so that the upper ends of the flexible rods are pivotally connected to the periphery of the mat, the fitting also including an entry into the socket cavity for the enlarged upper end of the flexible rod through an upper side of the fitting and a restricted entry towards the socket cavity for a part of the flexible rod below said enlarged upper end and through which the rod upper end cannot pass, to one side of the fitting and defined between opposed side or underside parts of the fitting.

15 Claims, 8 Drawing Sheets

TRAMPOLINE

FIELD OF INVENTION

The invention relates to improvements for a trampoline for sporting and/or recreational use which is soft-edged relative to conventional trampolines which support the mat of the trampoline via a solid peripheral frame and exposed springs between the frame and the mat.

BACKGROUND

U.S. Pat. No. 6,319,174 discloses a form of soft-edged trampoline in which the mat of the trampoline is supported by a plurality of resiliently flexible rods received in a frame of the trampoline at the lower ends of the rods and coupled to the periphery of the bouncing mat of the trampoline at their upper ends, and which avoids the need for a solid frame about the exterior of the bouncing mat and exposed springs between the frame and periphery of the mat.

PCT patent publications WO 03/043704 and WO 04/105886 relate to improved edge fittings for such soft-edged trampolines, for coupling the upper ends of the rods to the periphery of the mat. The fittings have a cavity on the underside of the fittings into which a ball-shaped upper end of a rod fits to connect the rod to the peripheral edge of the trampoline to form a coupling between the ends of the rods and the mat.

SUMMARY OF THE INVENTION

The invention provides an improved or at least alternative form of such a soft-edge trampoline, which comprises edge fitting which are designed with the objective of minimising the risk of accidental release of the flexible rods from the fittings by heavy bouncing on the trampoline.

In broad terms the invention comprises a trampoline including:

a flexible mat, a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the upper end of a flexible rod so that the upper ends of the flexible rods are pivotally connected to the periphery of the mat, the fitting also including an entry into the socket cavity for the enlarged upper end of the flexible rod through an upper side of the fitting and a restricted entry towards the socket cavity for a part of the flexible rod below said enlarged upper end and through which the rod upper end cannot pass, to one side of the fitting and defined between opposed side or underside parts of the fitting.

Preferably said restricted entry is defined between a part which depends downwardly from the underside of the fitting, from one side of said entry into the socket cavity for the upper end of the flexible rod, and the underside of the fitting.

In the trampoline of the invention the fittings by which the rod-springs or rods are coupled to the periphery of the mat provide a secure coupling between the upper ends of the rods and the mat. In particular the mat co-operates with the fittings to ensure the rods and mat remain more securely coupled while the trampoline is in use, while at the same time the fittings allow easy assembly and preferably also disassembly of the rods from the mat edge.

In this specification (including claims) the term "trampoline" is intended to extend to smaller trampolines commonly referred to as rebounders also, as well as larger trampolines of all sizes. Trampolines of the invention may be circular, square, rectangular, or of other shapes such as octagonally shaped in plan view for example.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

BRIEF DESCRIPTION OF THE DRAWINGS

Preferred forms of trampoline are described with reference to the accompanying drawings by way of example and without intending to be limiting, wherein.

DETAILED DESCRIPTION OF PREFERRED FORMS

Figure 1:
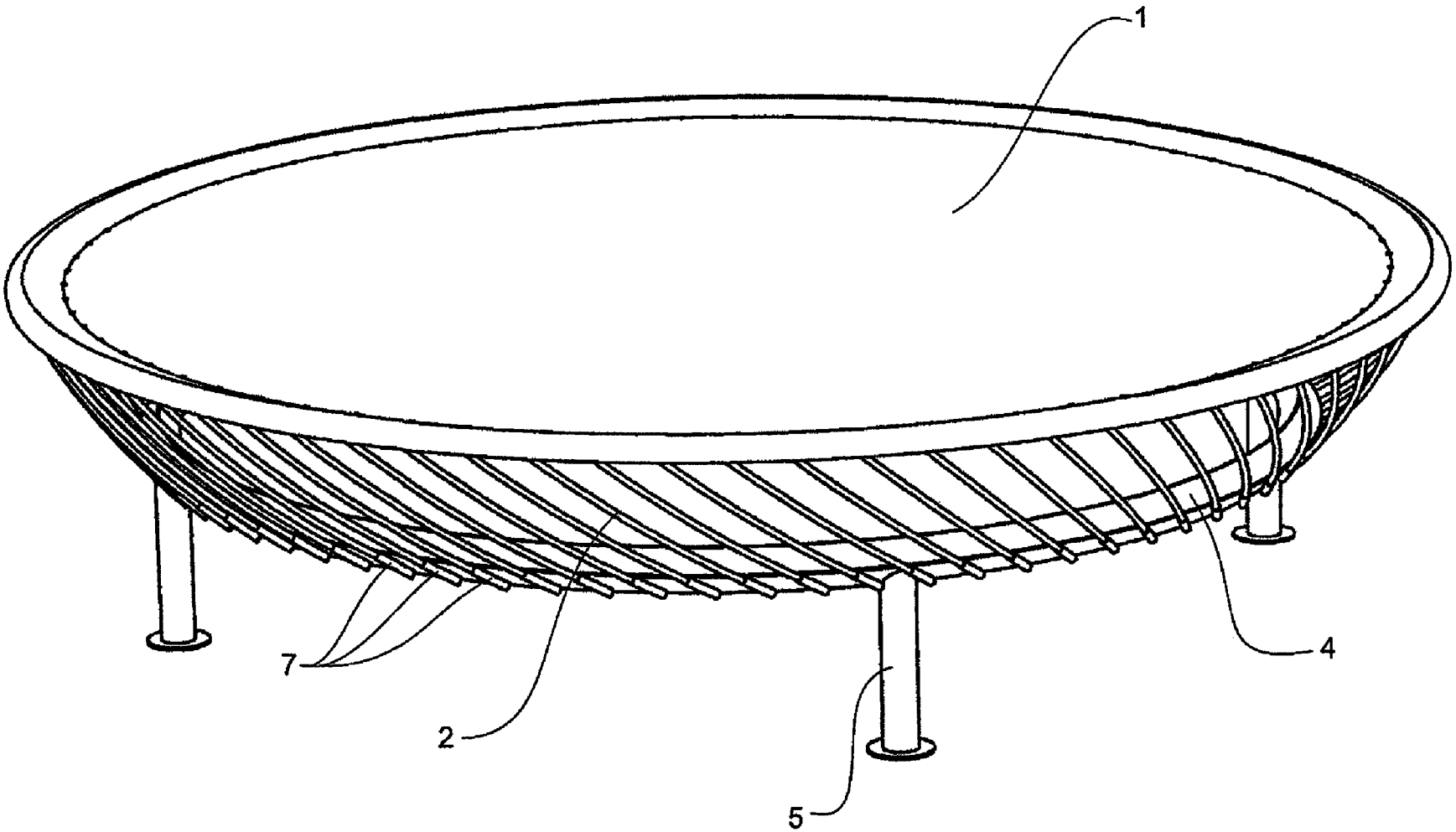
FIG. 1 is a perspective view of a trampoline.
Figure 2:
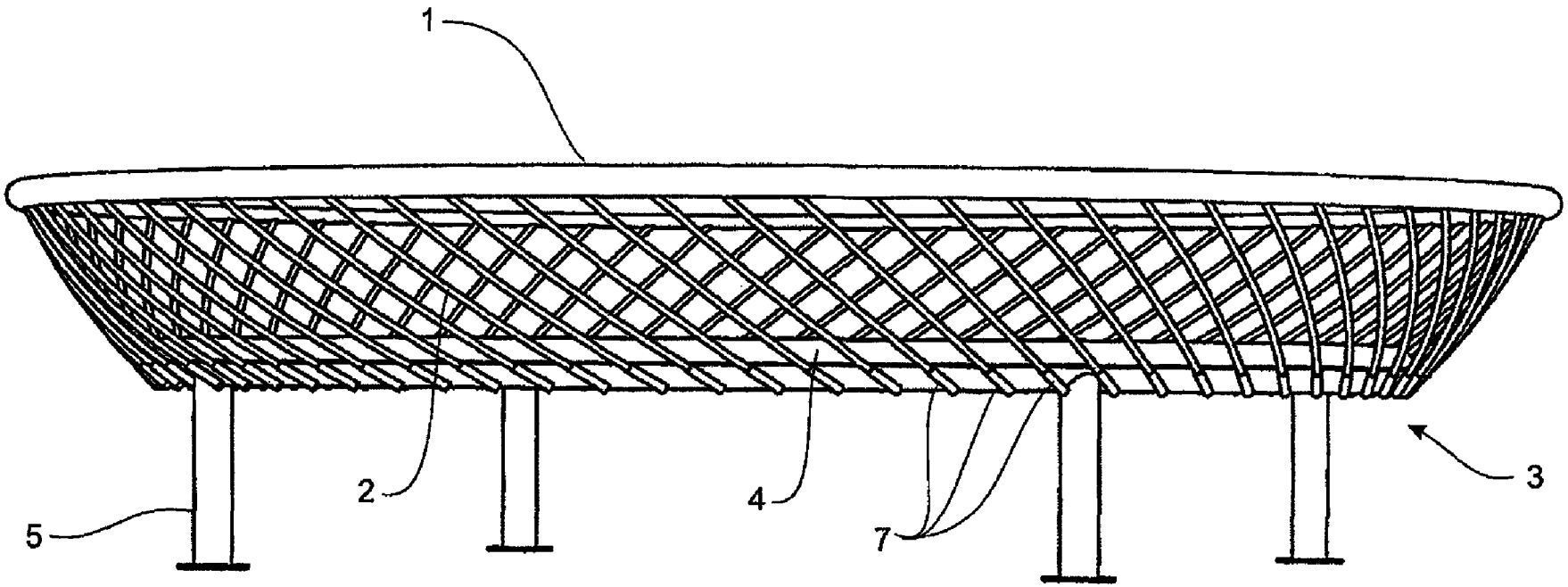
FIG. 2 is a side view of the trampoline of FIG. 1.
Figure 3:
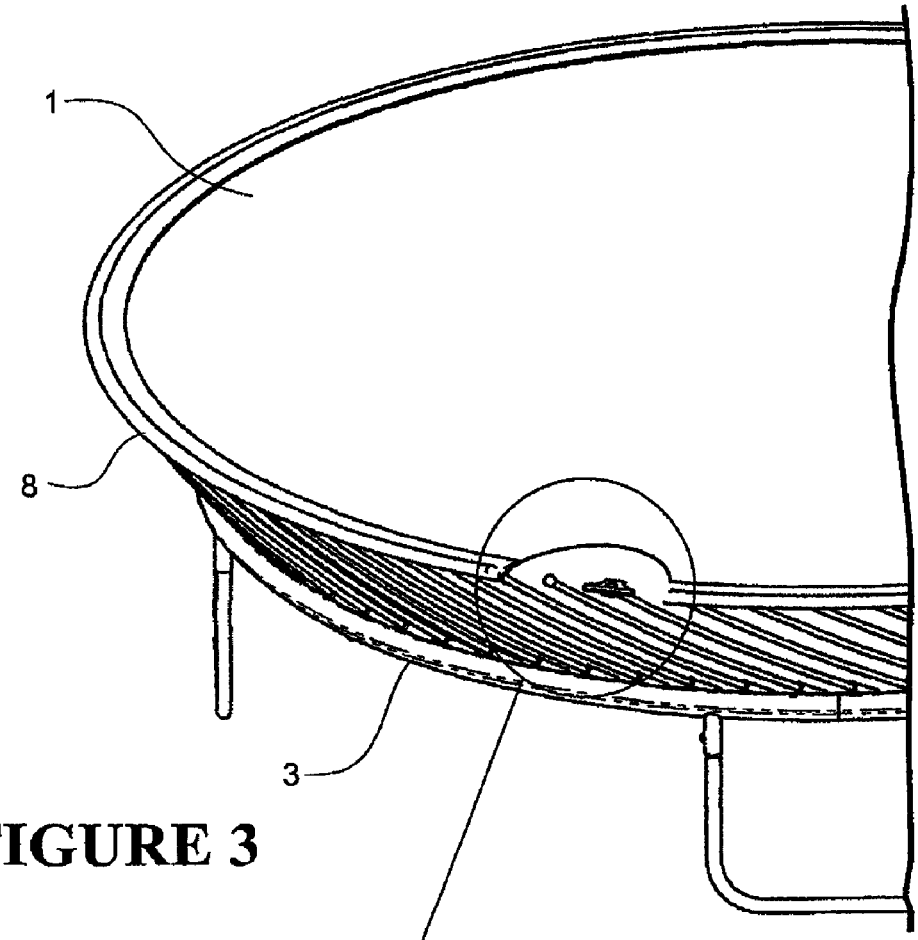
FIG. 3 is similar to FIG. 1 but of one side of the trampoline only and showing a portion of the edge of the mat of the trampoline cut away.

Referring to FIGS. 1 to 3, a soft-edged trampoline typically comprises a flexible mat 1 on which users may bounce, a plurality of resiliently flexible rods 2, and a base frame 3. The preferred form trampoline shown is circular in shape but the trampoline could be of any other desired shape such as oval, square, rectangular or similar.

The base frame of the preferred form trampoline comprises a circular beam 4 typically formed of steel or aluminium for example, which may be supported from the ground by legs 5.

The rods 2 are typically fibreglass rods but may alternatively be formed of spring steel for example. The lower ends of the rods are retained by the base frame 3 and the upper ends of the rods connect to fittings 6 as will be further described, which are coupled to the mat 1 about the periphery of the mat. In the preferred form the lower ends of the rods 2 enter into tubular holders 7 fixed to the circular beam as 4 shown, but the lower ends of the rods may be coupled to the circular beam, or a base frame of the trampoline of any other form, in any suitable way.

In the preferred form the mat 1, which is typically heavy canvas or a woven synthetic material, is doubled back upon itself and fixed by stitching for example about the periphery of the mat to form a continuous pocket 8 extending about the periphery of the mat. A number of the fittings 6 are positioned within this pocket in the peripheral edge of the mat as shown in FIG. 3 in particular. The fittings may be loosely captured within the pocket or alternatively may be stitched to the mat within the edge pocket, or mechanically fastened to the mat via rivets for example.

The rods have enlarged upper ends which connect to the fittings 6. FIGS. 4 to 11 show a preferred form of fitting and the connection of a rod end to the fitting in more detail. Preferably the fittings have a generally planar body portion 9. A socket cavity 10 is defined on or in an underside of the body portion 9 of the fitting. Preferably the body 9 of the fitting has a greater dimension approximately in the plane of the mat than in a direction through the mat. Typically the fittings will be formed from a plastics material, by injection moulding for example. In the preferred form portion 11 extends downwardly from the underside of the fitting to define the socket cavity 10. The rod end 12 fits into the socket cavity 10, as shown. The fitting may optionally include a slight dome 18 on body of the fitting over the socket cavity 10.

Also in the preferred form the fittings have an outer edge 13 which in use is closest to the outer peripheral edge of the mat, which edge 13 is wider in the plane of the mat than an inner edge of the fittings. The preferred form fittings have an approximate truncated triangular shape in plan view, with concave sides, but this is non-limiting and in other forms the fitting could be alternatively shaped.

Figure 3A:
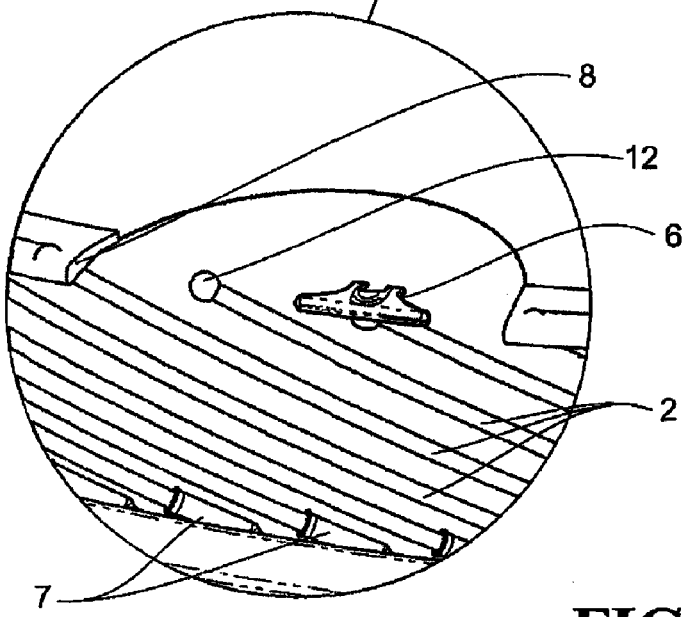
FIG. 3*a* is an enlarged view of the cut away edge portion of the trampoline.
Figure 4A:
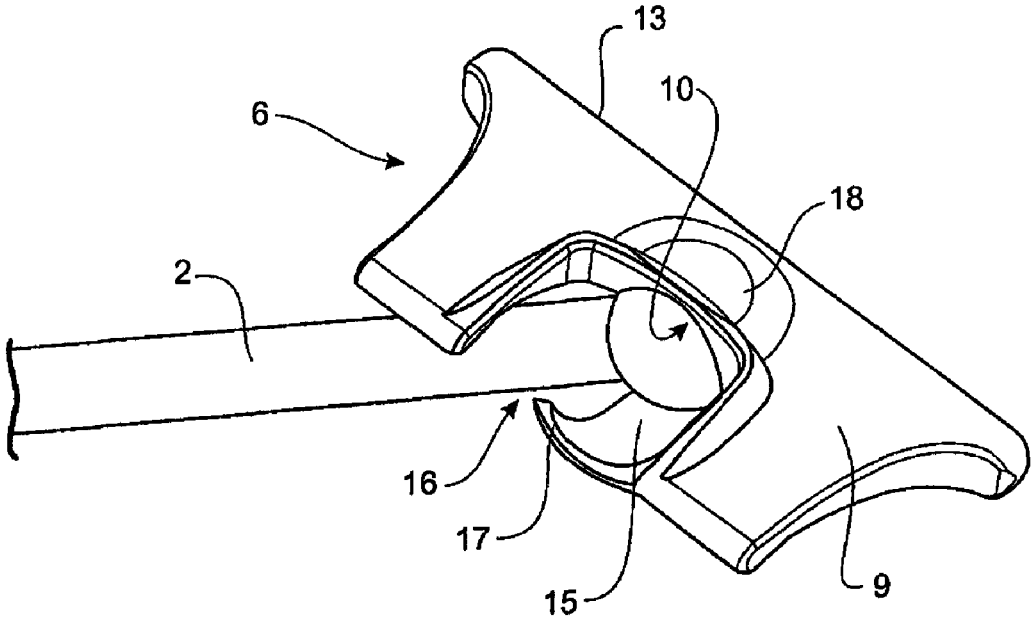
FIGS. 4*a* and 4*b* show a preferred form of an individual fitting and rod upper end separate from the other components of the trampoline, from above and below respectively.
Figure 4B:
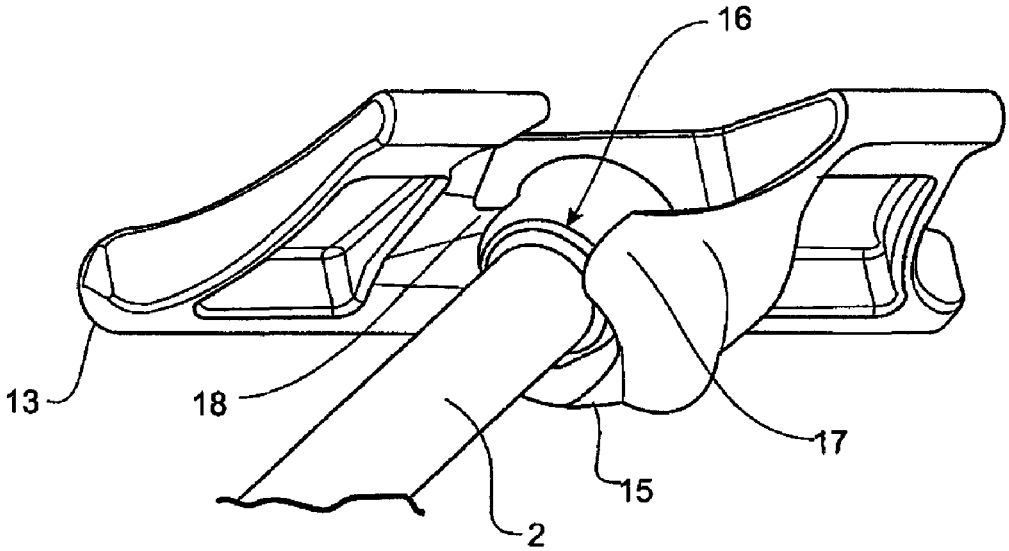

In the preferred form the part of the mat which is doubled back to define the pocket 8 in the peripheral edge of the mat wraps around the outer edges 13 of the fittings 6, as shown in FIGS. 3 and 3*a* so that in use the outer edges of the fittings contact the inside surface of the pocket at its outer edge as shown, which assists in transferring forces between the fitting and the mat or vice versa. This may not be essential however, and in an alternative form individual pockets may be formed adjacent but spaced from the outer most peripheral edge of the mat, and defined by stitching through the mat to form the pockets which each receive and retain a fitting. Alternatively again the fittings may instead of being received in a pocket or pockets in the outer edge of the mat, be stitched directly to the mat adjacent its outer edge, or mechanically fastened to the mat.

Typically the trampoline will be delivered to a purchaser in disassembled form. The purchaser need only insert the lower ends of the rods into the trampoline base, loosely place the mat over the trampoline base, and then bend each resilient rod as required to engage the upper ends 12 of the rods into the fittings 6.

In use as the trampoline is bounced on by a user, this will cause pivotal movement between the upper ends 12 of the rods 2 and the fittings 6 coupled to the mat, to a greater or lesser extent depending upon the size and energy of the user. If the user bounces close to a part of the edge of the mat, significant pivotal movement of the ball ends 12 of the few rods within the socket cavities 10 of the fittings closest to the point where the user bounces will occur.

In the trampoline of the invention each fitting includes an aperture or opening into the socket cavity 10 from above as indicated at 14. The opening 14 forms an entry into the socket cavity for the enlarged upper end 12 of the rod through the upper side of the fitting.

The fitting also has a restricted entry or passage 16 for a part of the flexible rod 2 below the enlarged upper end 12 towards the socket cavity between opposed side or under side parts of the fitting. This side passage or entry 16 is restricted in that it is sized such that the rod upper end 12 cannot pass through it. In the preferred form this restricted entry 16 is defined between parts 17 and 18 on the under side of the fitting. A part 15 on the under side of the fitting extends at least partially below the opening 14 through the top of the fitting, and part 17 extends around from the part 15 on the underside of the fitting, to define the restricted entry 16 between it and the underside of the fitting at 18.

The opening 14 in the top of the fitting is open at one side, to the same side as the side entry 16.

Figure 5A:
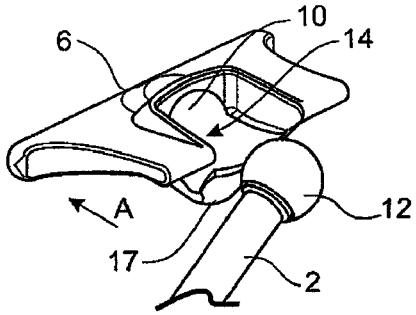
FIGS. 5 to 8 are a series of sequential views of an individual preferred form the fitting and rod upper end showing engagement of the rod end into the fitting from above—FIGS. 5A, 6A, 7A and 8A, and below—FIGS. 5B, 6B, 7B and 8B.
Figure 5B:
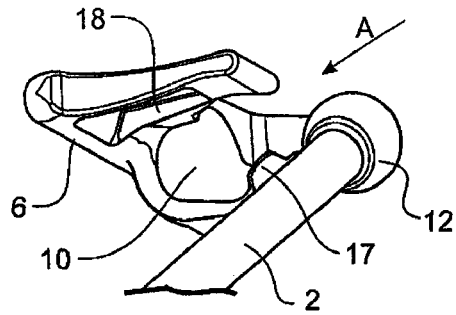
Figure 6A:
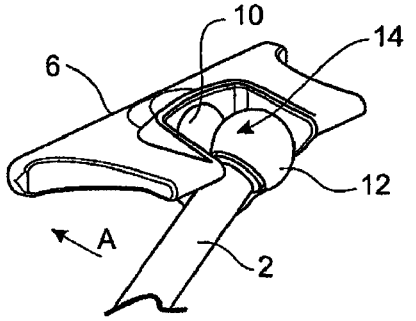
Figure 6B:
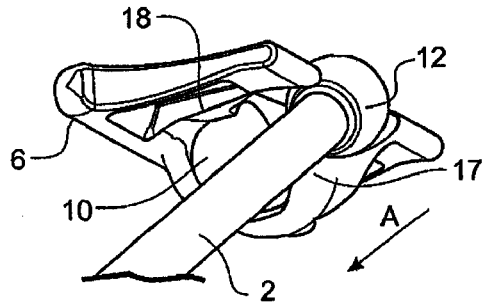
Figure 7A:
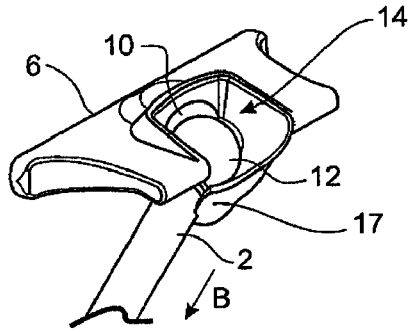
Figure 7B:
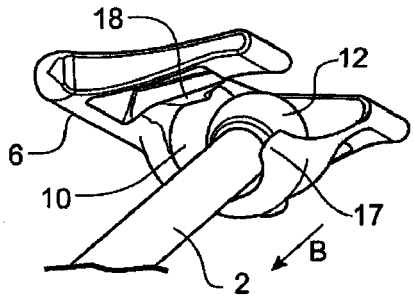
Figure 8A:
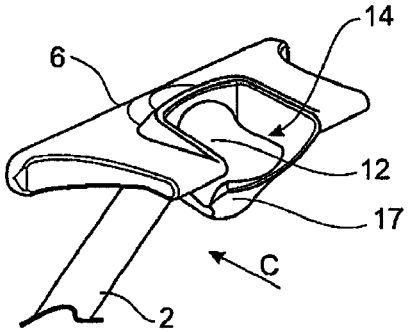
Figure 8B:
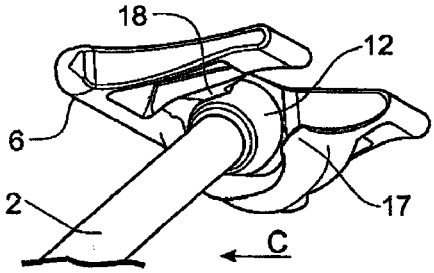

FIGS. 5 to 8 show the way which each rod end and fitting may be coupled together. Referring to FIGS. 5 and 6, the rod end 12 and fitting 6 are brought together so that the narrower part of rod below the enlarged end 12 passes through the restricted side entry 16 (defined between portions 17 and 18) of the fitting, into the interior of the fitting. At the same time the upper end 12 of the rod passes into the aperture 14 in the top of the fitting. Once the rod below the enlarged upper end has passed through the restricted entry 16, the fitting is moved upwardly as indicated by arrow B FIG. 7 FIG. 7. The fitting is then moved sideways relative to the fitting, as indicated by in arrow C in FIG. 8, to enter the upper end 12 of the rod fully into the socket cavity 10, to couple the rod and fitting together.

In initial assembly of the trampoline, once the rods have been installed in the base frame of the trampoline, by insertion of the lower ends of the rods into the base frame, and the mat with fittings 6 about its periphery is draped over the rods, then each fitting is engaged over an upstanding rod end to couple the fitting and rod end as described above. In disassembly of the trampoline for any reason, the sequence of operations is reversed.

Figure 9:
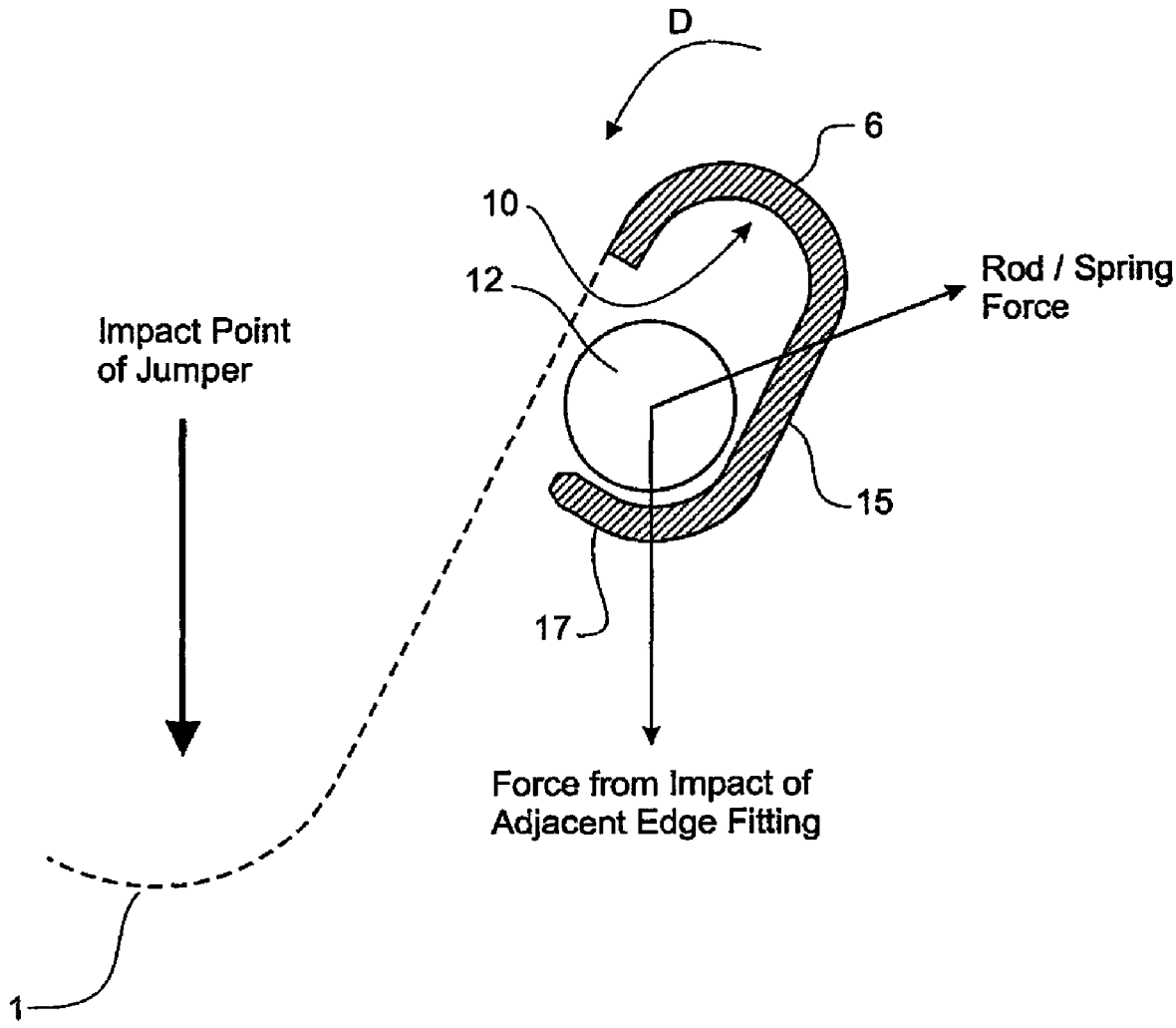
FIG. 9 is a schematic cross-section view through a fitting at a trampoline mat edge illustrating how mat co-operates with the fitting to ensure the fitting and rod remain coupled during jumping on the trampoline.
Figure 10A:
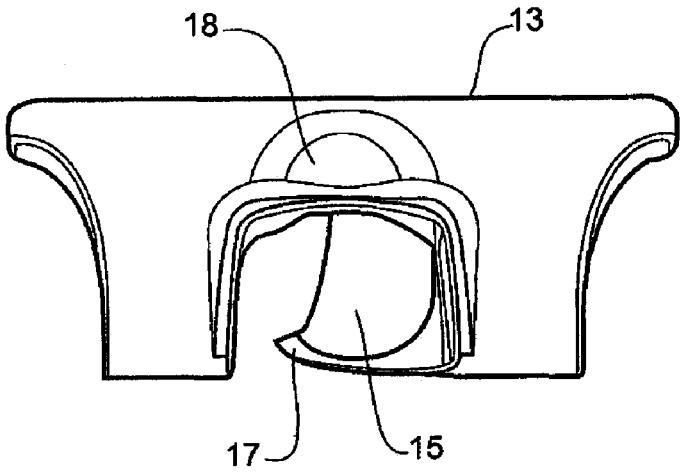
FIGS. 10*a* to 10*e* show the preferred form of fitting in plan view, from its inner edge, from below, and at an angle from below and above, respectively.
Figure 10B:
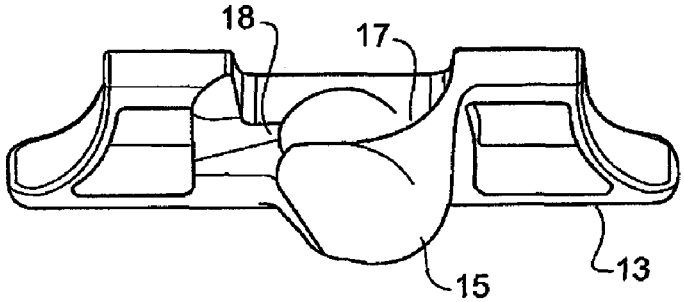
Figure 10C:
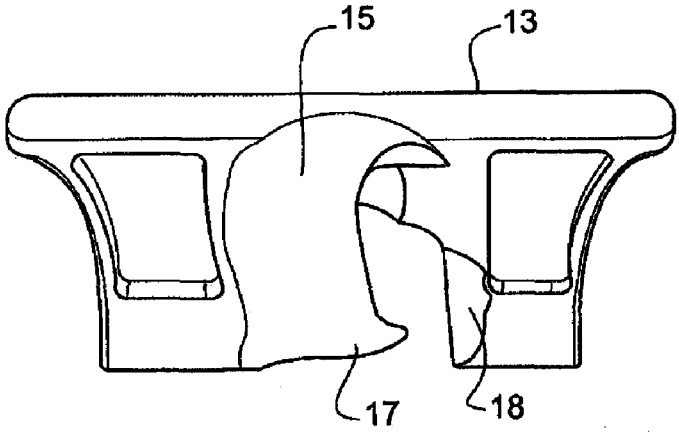
Figure 10D:
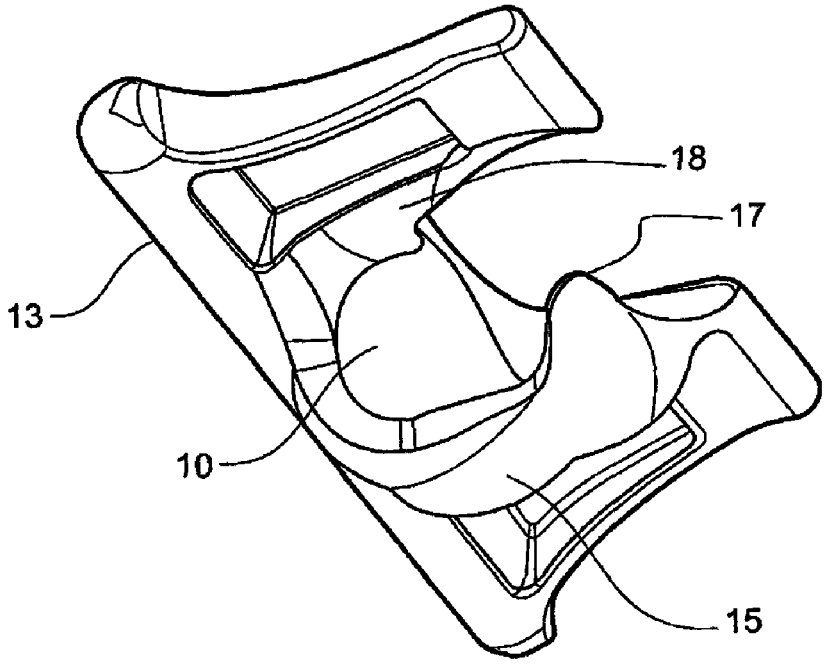
Figure 10E:
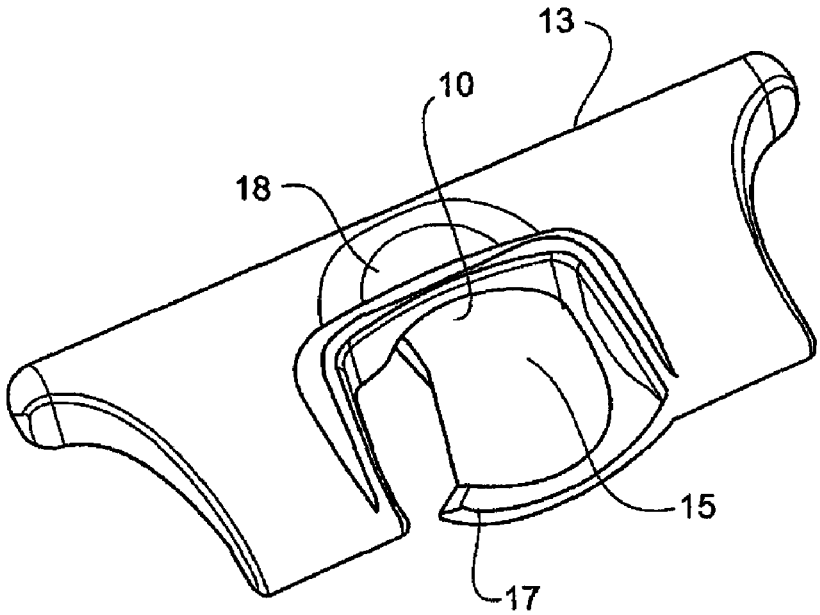

In the fully assembled trampoline, the taut mat 1 extends over the open aperture 14 through the top of each fitting 6, and assists to prevent the rod end from passing back out of the fitting during jumping on the trampoline. This is schematically illustrated in FIG. 9, which shows the forces acting on the rod end 12 relative to the fitting 6 during jumping on the trampoline, which cause the fitting to rotate in the direction of arrow D on the rod end 12, but also the mat to be pulled more tightly against the fitting to close the aperture 14.

Further, during heavy bouncing on the edge of the trampoline, the edge 17 of fitting 6 (the subject fitting) may impact on the rod immediately adjacent on one side and below it. This holds the subject up fitting while pushing the adjacent rod down. The rod coupled to the subject fitting (shown in FIG. 9) is also pushed down by the fitting adjacent on the other side and above it (not shown). The upper end 12 can be pushed out of the socket 10 of the subject fitting, but will impact on the "gate" 17. In this extreme-use situation, the gate 17, the taut mat 1 over the aperture 14, as well as the natural direction of the forces shown, all work together to prevent the rod end 12 from escaping altogether the fitting 6.

A secure and safe coupling of the upper ends of the rods to the mat is provided in both normal and extreme use, without adversely affecting the performance of the trampoline is use. In addition the ends of the flexible rods are enclosed to increase protection to a user falling on the edge of the trampoline. At the same time assembly and disassembly of the trampoline and in particular connection between the individual rods and the mat can be carried out with relative ease.

The foregoing describes the invention including a preferred thereof so alterations and modifications as will be obvious to those skilled in the art are intended to be incorporated within the scope hereof as defined in the accompanying claims.

The invention claimed is:

1. A trampoline including:

a flexible mat, a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the upper end of a flexible rod so that the upper ends of the flexible rods are pivotally connected to the periphery of the mat, the fitting also including an entry into the socket cavity for the enlarged upper end of the flexible rod through an upper side of the fitting and a restricted entry towards the socket cavity for a part of the flexible rod below said enlarged upper end and through which the rod upper end cannot pass, to one side of the fitting and defined between opposed side or underside parts of the fitting.

2. A trampoline according to claim 1 wherein said restricted entry is defined between a part which depends downwardly from the underside of the fitting, from one side of said entry into the socket cavity for the upper end of the flexible rod, and the underside of the fitting.

3. A trampoline according to claim 2 wherein the fitting includes a part which extends at least partially below said entry into the socket cavity for the upper end of the flexible rod, on the underside of the fitting.

4. A trampoline according to claim 1 wherein the fitting includes a part which extends at least partially below said entry into the socket cavity from one side of said entry into the socket cavity, and the underside part of the fitting on an opposite side thereof.

5. A trampoline according to claim 1 wherein a part of the each fitting which defines the socket cavity in or on the underside of the fitting, depends downwardly from the underside of the fitting.

6. A trampoline according to claim 1 wherein the fittings are one piece fittings formed from a plastics material.

7. A trampoline according to claim 1 wherein the enlarged upper ends of the rods are separately formed from the rods and are fitted to the upper ends of the rods.

8. A trampoline according to claim 1 wherein the fittings have an outer edge adjacent an outer edge of the mat, which outer edge of the fittings is wider approximately in the plane of the mat than an inner edge of the fittings.

9. A trampoline according to claim 8 wherein the widest dimension of the fittings approximately in the plane of the mat is at an outer edge of the fittings closest to an outer edge of the mat.

10. A trampoline according to claim 1 wherein the fittings have an approximate truncated triangular shape in plan view.

11. A trampoline according to claim 1 wherein the fittings are positioned within a pocket or pockets in or adjacent the peripheral edge of the mat.

12. A trampoline according to claim 11 wherein a part of the mat defining the pocket or pockets wraps around the outer edge of the fittings.

13. A trampoline according to claim 1 wherein the fittings are stitched to the mat or otherwise mechanically fastened to the mat.

14. A trampoline including:

a flexible mat, a plurality of resiliently flexible rods each having a lower end retained in a frame of the trampoline and an enlarged upper end, and a plurality of fittings coupled to the mat about a periphery of the mat and including on or in an underside of each fitting a socket cavity which receives the upper end of a flexible rod so that the upper ends of the flexible rods are pivotally connected to the periphery of the mat, the fitting also including an entry into the socket cavity for the enlarged upper end of the flexible rod through an upper side of the fitting and a restricted entry towards the socket cavity for a part of the flexible rod below said enlarged upper end and through which the rod upper end cannot pass, to one side of the fitting and defined between a part which depends downwardly from the underside of the fitting, from one side of said entry into the socket cavity for the upper end of the flexible rod, and the underside of the fitting.

15. A trampoline including:

a flexible mat, a plurality of resiliently flexible rods each having a lower end retained in a frame of the trampoline and an enlarged upper end, and a plurality of one piece fittings formed from a plastics material, coupled to the mat about a periphery of the mat and including on or in an underside of each fitting a socket cavity which receives the upper end of a flexible rod so that the upper ends of the flexible rods are pivotally connected to the periphery of the mat, the fitting also including an entry into the socket cavity for the enlarged upper end of the flexible rod through an upper side of the fitting and a restricted entry towards the socket cavity for a part of the flexible rod below said enlarged upper end and through which the rod upper end cannot pass, to one side of the fitting and defined between opposed side or underside parts of the fitting, the fittings having an outer edge adjacent an outer edge of the mat, which outer edge of the fittings is wider approximately in the plane of the mat than an inner edge of the fittings.

* * * * *